US005553421A

United States Patent [19]

Stratford

[11] Patent Number: 5,553,421

[45] Date of Patent: Sep. 10, 1996

[54] STRUCTURAL BUILDING COMPONENTS

[76] Inventor: Aloth U. Stratford, 31A Frere Road, Vincent, East London, South Africa

[21] Appl. No.: 245,493

[22] Filed: May 18, 1994

[30] Foreign Application Priority Data

| | | | |
|---|---|---|---|
| Sep. 11, 1993 | [ZA] | South Africa | 93/1739 |
| Sep. 21, 1993 | [ZA] | South Africa | 93/4422 |
| Sep. 21, 1993 | [ZA] | South Africa | 93/6954 |

[51] Int. Cl.[6] ..... E04F 11/00

[52] U.S. Cl. ..... 52/182; 52/188; 52/191; 182/228

[58] Field of Search ..... 52/182, 183, 188, 52/189, 191, 185; 182/228

[56] References Cited

U.S. PATENT DOCUMENTS

| | | | |
|---|---|---|---|
| 3,986,579 | 10/1976 | Howard et al. | 182/189 |
| 5,131,197 | 7/1992 | Varga | 52/183 |

FOREIGN PATENT DOCUMENTS

| | | | |
|---|---|---|---|
| 970212 | 6/1950 | France | 52/189 |
| 1211126 | 10/1959 | France | 52/182 |
| 94645 | 9/1969 | France | 52/183 |
| 2665920 | 2/1992 | France . | |
| 804854 | 4/1951 | Germany | 52/189 |
| 837595 | 4/1952 | Germany | 52/189 |
| 2228458 | 12/1973 | Germany | 52/183 |
| 2600057 | 7/1977 | Germany . | |
| 614465 | 12/1948 | United Kingdom . | |

*Primary Examiner*—Wynn Wood
*Assistant Examiner*—Aimee E. McTigue
*Attorney, Agent, or Firm*—Peter L. Michaelson; John C. Pokotylo; Michaelson & Wallace

[57] ABSTRACT

Prefabricated, preferably pre-cast concrete, stringers and treads can be employed to provide either a staircase of any required inclination, a horizontal walkway or a ramp of a required inclination. In all these applications, the same standardized stringers and treads can be effectively used. Stanchions can be added as required. Further embodiments can be used for providing ladders and for providing seating for grand stands or theaters.

4 Claims, 9 Drawing Sheets

STRUCTURAL BUILDING COMPONENTS

FIELD OF THE INVENTION

This invention lies in the field of construction. One embodiment of the invention, for example, relates to a stringer and tread combination for use in the construction of a staircase, ramp or walkway. The scope of the invention extends to the stringer and the tread and to a method of establishing a staircase, ramp or a walkway.

Another embodiment of invention, however, is also useful in creating seating structures, and in particular, seating structures which are applicable for the manufacture of grand stands or seating arrangements for theatres, both open air and indoor, although primarily the former.

The concept of the invention can be further extended to creating ladders or very steep staircases or step ways. The steepest staircase allowed by official building regulations is inclined at approximately 40° to the horizontal. At angles of inclination greater than 40°, the structure can conveniently be referred to either as a very steep staircase or preferably referred to as a ladder.

This invention provides structural building components which may be precast and applied in all of the above mentioned areas.

SURVEY OF RELATED ART

Staircases present many on-site problems for the builder. Floor-to-floor heights vary, as do riser and tread dimensions. Typically, skilled carpenters set out and build the shuttering (i.e., concrete form) with extensive propping and specially designed reinforcing which are required before the concrete is poured. Space is needed for storing the reinforcing and shuttering material. Further, concrete spills resulting from bleeding and inadvertantly kicking shuttering and careless barrow-handling add to the general mess and congestion in the very place where easy access to upper floors would enhance efficiency and project completion.

Proposals for prefabricated staircases have been made and examples can be found in the art.

French Patent No. 90 10433 describes a stringer and tread construction for a staircase in which the stringers have a substantially conventional stepped construction for supporting a tread on each step. A radius of curvature on the upper surface of each step is matched by a similar radius of curvature on the lower surface of each tread by which only a very limited amount of adjustment of the tread, so as to be perfectly level, can be achieved. However, the teaching of the French patent is confined to faciliating only limited adjustment of the treads for the purpose of levelling them.

Rather similarly, the U.S. Pat. No. 3,986,579 also teaches only the possibility for accurately levelling the steps at the job site after the stringers have been installed. Angular rotation is described as being quite limited, as is shown in the view of FIG. 3 where a bolt 8 must move within a slotted hole 41 of limited dimension.

SUMMARY OF THE INVENTION

By contrast, the object of the present invention is to permit the same stringers and treads to be used to provide not only a staircase of any angle of inclination, but even down to horizontal, that is, to serve as a walkway and all other angles between horizontal and normal maximum for a staircase of about 40° inclination. The system can also be used to produce ramps, that is, to provide a smooth surface that rises on an incline.

Special embodiments of the invention can be extended to provide very steep staircases or ladders.

This underlying principle of the invention can also be applied to provide seating ramps for theatres and stadiums.

In accordance with the present invention, a stringer and tread combination is provided in which the stringer is lengthwise provided with successive integrally formed scallops, each of which has a lengthwise shape conforming to the arc of a circle and each of which scallops can accommodate at least part of an underside of a tread, which underside has a co-acting shape to that of the scallops.

By "integrally", it is meant that the scallops and the stringer form one component, i.e., the scallops have not been separately added to the stringer.

It is a characteristic of this invention that each scallop begins and ends on the same longitudinal line of the stringer, or substantially so.

The transverse shape of each scallop may be linear.

It is an important feature of the invention that the same stringer and tread combination can be used in the manufacture of a stairway, walkway and ramp.

Generally, two stringers will support a plurality of treads. However, in an embodiment of the invention in which the scallops are provided in the top surface of the stringer, a single stringer can be employed in creating a walkway, ramp or staircase using treads having suitable lengths.

In another embodiment of the invention in which the combination comprises two opposed, spaced apart and generally parallel stringers, an inner side surface of each stringer includes scallop shaped corbels for supporting the end portions of the treads. A single projection constituting a plurality of corbels may be provided on the inner side of the stringer. Alternatively, a plurality of projections, each of which constitute a corbel, may be provided on the inner side of the stringer.

Preferably, the treads and the stringers are manufactured of precast concrete.

Generally, each of the scallops must have the same pitch to comply with good practice and official building regulations.

In a preferred embodiment, an underside, or at least part of the underside, of each tread is secured in a scallop by means of glue. Glues which may be employed include those of the epoxy type and of the poly-sulphide type. The applicant has found that the epoxy type of glues provide a rigid joint whereas the poly-sulphide types provide a more flexible joint which is preferred for staircases where only the rear portion of the tread overlaps with the stringer and the front portion forms a cantilever which is stepped on during use and provides a better impact strength. Alternative ways of securing the treads to a stringer are envisaged and include mechanical keys, for example dove-tail joints, and bolt and nut connections. The dove-tail joint may include an aluminum extrusion suitably cast into the stringer.

To render the treads more resistant to tensile stresses, the treads may be provided with reinforcements, for example, metal bars cast into the treads, especially in the overlap mentioned above.

To reduce the mass of a stringer, it may be provided with holes extending from side to side, which holes are open to the outside. The holes also facilitate transportation of the stringers because a means, for example a crowbar or a sling, can be located there through. The holes also facilitate fixing the stringers, e.g., to columns, etc.

The stringer may be provided with inner reinforcements rendering the stringer more resistant to tensile stresses. The reinforcements are preferably located between the holes and the top surface and between the holes and the bottom surface of the stringer. Metal bars cast into the stringers are preferred.

An advantage of the invention is that in the construction of a staircase, the scallops allow the stringer(s) to be raked to any suitable angle. After having raked the stringer(s) to the required angle, the treads are located in the scallops and the upper tread surfaces levelled. Alternatively, the treads can be simultaneously raised with the stringers after treads have been rotated and secured in the scallops so that the upper tread surfaces become level when the stringers have been raised.

Preferably, each tread has a generally flat upper surface.

The scallops in the stringer(s) allow the treads to be secured parallel to the stringer(s) for creating a walkway or a ramp.

An end portion of the stringer may be provided with half a scallop such that two stringers having such end portions can be mated in an end to end configuration which will provide a full scallop. The applicant has found that such stringers can be used where a change in the direction of a walkway or a ramp is desired. It will be appreciated that where the change in direction occurs a gap is generated between the two successive treads. A suitable landing may be used to fill this gap.

An end portion of a tread may be adapted for mounting a stanchion. For example, the end portion may be provided with a suitable hole, preferably formed during casting. Stanchions may alternatively be secured to stringers.

It will be appreciated that the invention provides a versatile stringer and tread combination.

The scope of the invention extends to the stringer alone, the tread alone and to methods of manufacturing the stringer and tread, each of which methods preferably includes a step of casting the stringer or tread using a suitable concrete.

Each tread may have a riser added to it which preferably depends from the front underside of the tread. The tread and the riser may be integrally cast of concrete. Alternatively, the riser may be a separate component which fits into a groove provided in the front underside of the tread. Otherwise the risers may be open.

In accordance with the present invention, there is provided a method of establishing a staircase or a ramp, which staircase or ramp uses the stringer and tread combination of the invention.

The method includes a step of raking the stringer(s) to a required angle and a step of securing at least part of an underside of each tread in a scallop after the stringer(s) has been raked to the required angle. The upper tread surfaces are then levelled in the case of the staircase. In the case of a ramp or walkway, the upper tread surfaces are then arranged so that they are generally located in a plane.

The scope of the invention extends to a method of establishing a horizontal walkway using the stringer and tread combination. The method includes a step of arranging the stringer(s) in a horizontal position. The method further includes a step of securing at least part of an underside of each tread in a scallop after the stringer(s) has been arranged horizontally and the upper tread surfaces levelled.

The stringers will be designed (e.g., in suitable steel reinforced concrete) to serve as end-supported beams, in most applications. However, the lengths of the stringers can also be bedded in soil or concrete to provide staircases, ramps or walkways on soil or concrete ramps or beds.

This basic structure can also be applied to the manufacture of grand stands since, in simple form, they are conceptually equivalent to a large scale staircase where the riser height in staircases corresponds to the height of the seat and the tread in staircases corresponds to the seat itself. In grandstand applications, preferably sufficient space is provided behind a seated person for the feet of the next user to gain access to the next seating place.

The principle is thus also applicable to providing seating in theatres and similar buildings and also stepped surfaces in theatres and similar buildings for providing conventional seating rows on such stepped surfaces in theatres.

In a typical grand stand application, seat heights may vary from 300 mm to 500 mm high. Outside this range, the comfort zone may be exceeded. A suitable seat including access behind it, should be on the order of 800 mm wide, or in the range between 780 mm to 850 mm.

The invention can be implemented with materials other than concrete, for example, timber and plastic. The aesthetic possibilities inherent in the invention can, for example be realized with particular attractiveness in timber. Technological adaptations of the principle to timber would include the possibility that the treads would be glued and screwed to the stringers.

Furthermore, in the case of timber, a corbel could be separately fabricated and fastened to the stringer by nailing, screwing and/or gluing, for example. A further interesting possibility, which is perhaps particularly apt with the use of timber, is to raise the angle of the staircase towards 90° when it becomes tantamount to a ladder. This application could, of course, also be implemented in concrete and other materials.

The application of the invention in plastics materials could be employed by techniques in which the tread is extruded. The stringers could be manufactured in modular form and then assembled. Fiber re-inforcement techniques of the plastic could be useful in both the stringers and the treads.

In the application of the invention to grand stands and similar applications as discussed herein, the scale of the modular component such as the stringers and seats or seating platforms may well result in the components having to be placed in situ on a building site by means of suitable cranes. Thus, these applications are in contrast to the application for staircases where the components can, in many cases, be small enough to be manhandled into place.

The principle of the invention can furthermore be extended, as has been stated, to provide ladders or very steep staircases, that is, at angles greater than is conventionally permitted, for example by standard building regulations for staircases, around 40° or 45°.

Prior art proposals have been made for stringer and tread combinations in which, even if the tread is given a hemicylindrical under surface, the stringers do not have merely circular scallops. Instead, the stringers have more complicated indentations, notches or other formations for receiving the treads, thus giving them support on steeper angles of inclination. The shortcoming of these known proposals is that such stringers cannot be used over a wide range of angles of inclination from the horizontal. Indeed, such stringers may be used only over a very small range of variation of a few degrees, for example, and certainly may not be used to the point where the stringer and tread combination can be used to provide a walkway or ramp. For these purposes, these known proposals of which the inventor is aware are quite unsuitable.

A further object of this invention is therefore to further extend the concepts described thus far to allow the stringer to be used at any angle between horizontal and an angle very close to vertical.

In accordance with this invention, the essential feature is that the scallop diameter is less than the pitch between treads, and that the arc of the scallops is close to a semi-circle (i.e., 180°). In the preferred embodiment, this feature will be met by means of short straight portions, parallel to the length of the stringer, between scallops.

A secondary effect of this approach is that the treads have a relatively deep profile which can, of course, advantageously increase bending strength in the cases of long spans or in canti-lever arrangements for the tread.

BRIEF DESCRIPTION OF THE DRAWINGS

The invention will now be described by way of various examples with reference to the accompanying drawings in which.

DESCRIPTION OF THE PREFERRED EMBODIMENTS

Figure 1:
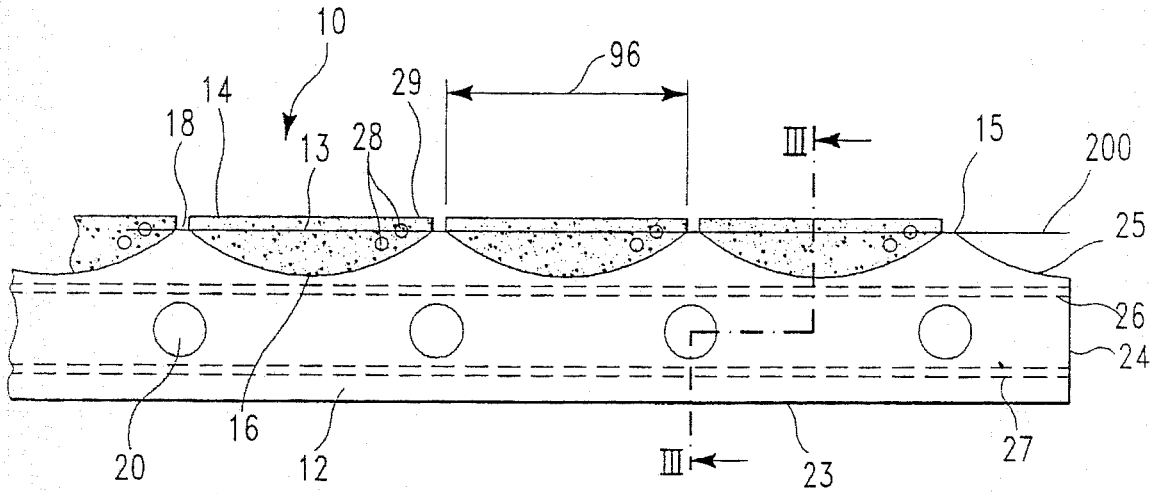
FIG. 1 is a partial side view of a stringer and tread combination in accordance with the present invention.

In FIG. 1 the reference numeral 10 generally indicates a stringer and tread combination in accordance with a first embodiment of the present invention. The stringer and tread combination 10 comprises a precast concrete stringer 12 and a plurality of precast concrete treads 13 each having an upper tread surface 14.

The top surface 15 of the stringer 12 is lengthwise provided with successive scallops 16. Lengthwise, the shape of each scallop 16 conforms to the arc of a circle as shown in FIG. 1. In the transverse direction the shape of each scallop 16 is linear. A gap 18 is provided between each of the scallops 16 and an adjacent scallop. FIG. 1 shows that the shape of the underside of each tread 13 co-acts (mates) with the shape of the scallops 16. Every scallop (i.e., the arc of each scallop) begins and ends on the same longitudinal line 200.

Figure 3:
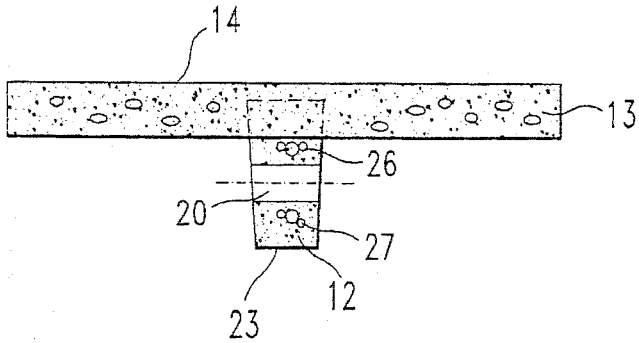
FIG. 3 is a cross-sectional end view of the combination along m—m in FIG. 1.

FIG. 3 shows that the stringer 12 has a trapezoid shaped cross-section which the applicant has found to be advantageous for casting and for removal of the stringer 12 from a mold after having been cast. The shape is useful in providing a greater width at the top to bear compressive stress. Tensile stress at the bottom is born by steel re-inforcing, in beam loading.

The stringer 12 is provided with a plurality of side to side holes 20 extending through the stringer 12. The holes 20 reduce the mass of the stringer 12 and facilitate transportation thereof. Crowbars can be located through the holes 20 thus enabling the stringer 12 to be carried. For raising the stringer 12, a sling and crane can be used with the sling located through the hole 20 and fastened to the stringer 12.

Each tread 13 can be secured parallel with the line 200 defined by the ends of the scallops 16 of the stringer 12 as shown in FIG. 1. More specifically, the upper tread surface 14 is generally parallel with the bottom surface 23 of the stringer 12. This embodiment of the combination 10 can thus be used to construct a horizontal walkway or a ramp.

To establish a horizontal walkway, a ramp or a staircase the stringer(s) 12 can simply be laid onto a surface or the bottom surface 23 of the stringer 12 can be embedded in the ground. Overhead walkways and ramps can be constructed by using supports, for example poles or columns, which may be secured to the stringers 12 via the respective holes 20. After having arranged the stringer(s) 12 as aforementioned, the treads 13 are arranged in the scallops 16 and the upper tread surfaces 14 levelled (i.e., are made to be parallel with one another) when a walkway or staircase is constructed. For a ramp, the upper tread surfaces 14 are arranged so that they are generally coplanar. The treads 13 are then secured to the stringer(s) 12 by gluing their undersides to their respective scallops 16.

An end portion 24 of the stringer 12 is provided with half a scallop 25 which allows two stringers 12 to be mated in an end to end configuration. The mated end portions 24 will thus provide a full scallop, akin to the scallop 16, into which a tread 13 can be located. A walkway or a ramp having a change in direction can also be constructed using a plurality of the stringers 12. Viewing such a walkway or ramp from above will show that a gap is formed between two successive treads 13 where a change in direction occurs. A suitable landing can be used to fill this gap (See, e.g., FIG. 14).

Figure 2:
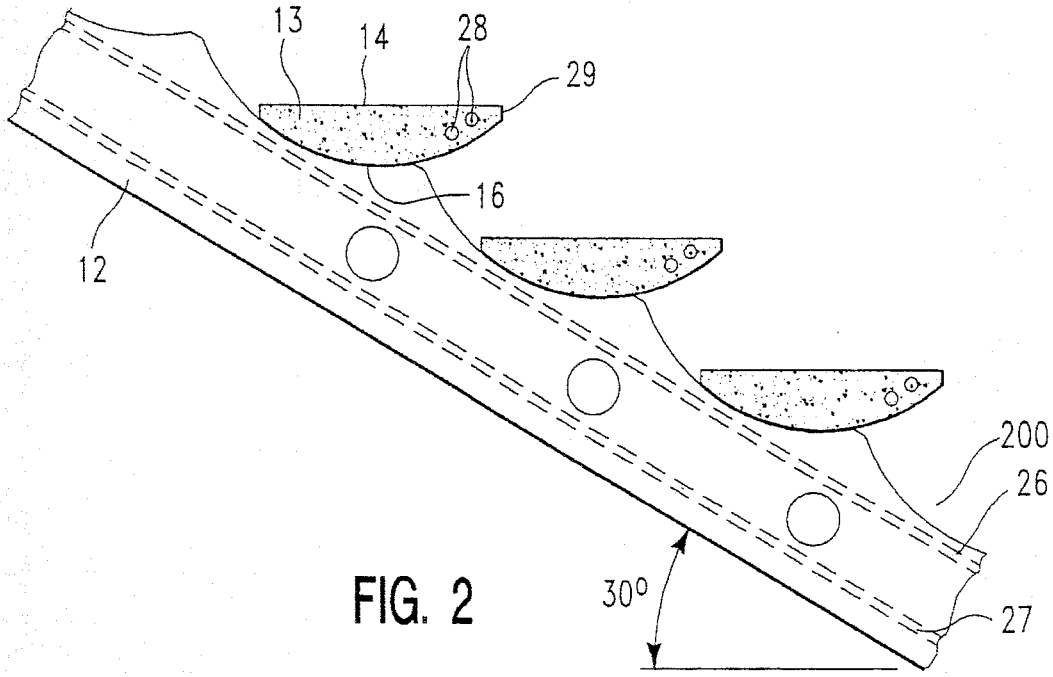
FIG. 2 is a partial side view of a staircase comprising the combination shown in FIG. 1.

FIG. 2 shows a staircase 30 which has been constructed using the same stringer and tread combination 10 shown in FIG. 1. The staircase 30 has been established by raking the stringer 12 to an angle of 30 degrees. The treads 13 have been rotated in the scallops 16 to render the upper tread surfaces 14 level. After having been levelled, the underside of each tread 13 in contact with the scallops 16 is secured to the stringer 12 in the scallops 16 by means of gluing. Installing the staircase 30 may be accomplished by, preferably, first raking the stringer 12 to the required angle and then locating the treads 13 in their respective scallops 16. Alternatively, the treads 13 can be simultaneously raised with the stringers 12 after the treads 13 have been rotated and secured by means of gluing in the scallops 16 so that the upper surface 14 of each tread 13 becomes level when the stringers 12 have been raised.

It will be appreciated that the walkway, ramp and staircase 30 may comprise one or more stringers 12 for supporting the treads 13. Referring to FIG. 3, a cross-section is shown of a ramp or walkway using only one stringer 12. This type of stringer 12, which passes beneath the treads 13, allows the treads 13 to form cantilevers as is evident from FIG. 3.

FIGS. 1, 2 and 3 show that the stringer 12 and tread 13 have been provided with cast in re-inforcements in the form of metal bars 26, 27, 28. The bar 26 is located between the holes 20 and the top surface 15 of the stringer 12 while the bar 27 is located between the holes and the bottom surface 23 of the stringer 12. The bars 28 are provided in the overlap 29 of each tread 13 to render the treads 13 more resistant to tensile stresses during stepping onto the upper tread surface 14 of the overlap 29.

Figure 4:
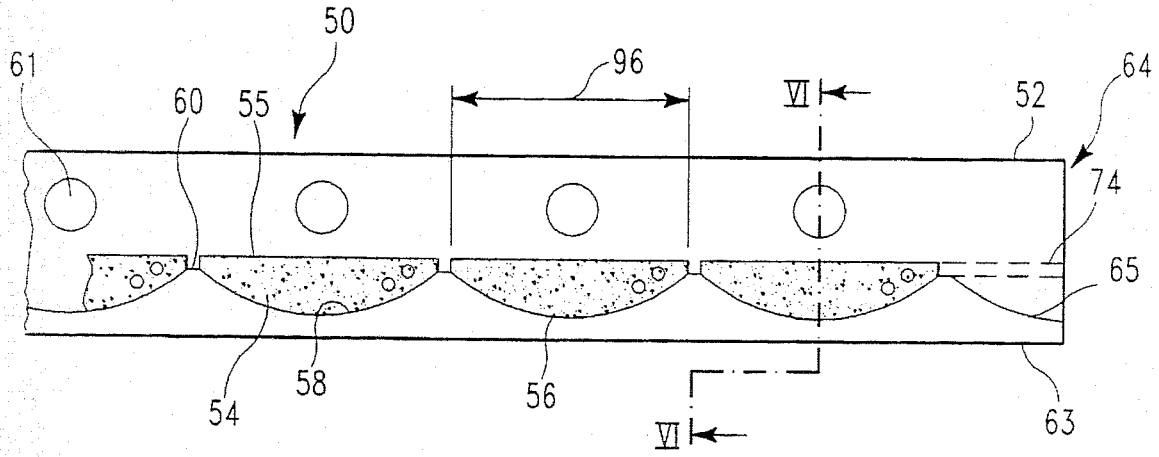
FIG. 4 is a partial side view of another stringer and tread combination in accordance with the present invention.

FIG. 4 shows another embodiment of a stringer and tread combination which is generally indicated by the reference numeral 50. The stringer and tread combination 50 comprises a precast concrete stringer 52 and a plurality of precast concrete treads 54 each having a generally flat upper tread surface 55.

The stringer 52 is provided with a single projection constituting a plurality of corbels 56. Each corbel 56 defines a scallop 58 having the same shape as that of the scallops 16 shown in FIGS. 1 and 2. A gap 60 is provided between each scallop 58. FIG. 4 shows that the underside of each tread 54 has a co-acting (mating) shape to that of the scallops 58.

The stringer 52 is further provided with a plurality of holes 61 serving the same purpose as the holes 20 of the first embodiment stringer 12.

Figure 6:
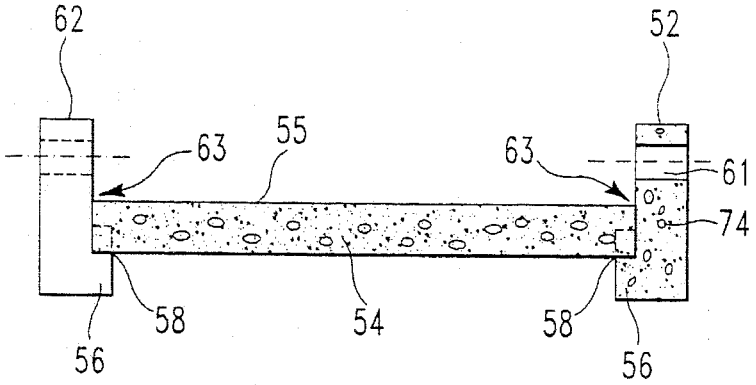
FIG. 6 is a cross-section of the combination along VI—VI in FIG. 4 in which a tread is shown having a mirror image to that of the tread shown in FIG. 4.

The combination in FIG. 4 can be used to construct a horizontal walkway, a ramp or a staircase. As shown in FIG. 6, at least two stringers must be employed, the one being the stringer 52 and another stringer 62 having the mirror image of the stringer 52. These stringers 52, 62 are used in pairs, as shown in FIG. 6, with the stringers 52 and 62 arranged opposite, spaced apart and generally parallel to one another. As was the case with the stringer(s) 12, the mentioned pairs of stringers 52, 62 can simply be laid onto a surface or with the bottom surface 63 embedded in the ground. Overhead walkways and ramps can also be constructed by using supports, for example poles or columns, which may be secured to the stringers via the respective holes 61. After having located the stringers 52, 62 as aforementioned, the end portions 63 of the treads 54 are located in the respective scallops 58 and the upper tread surfaces 55 are leveled when a walkway or staircase is constructed. For a ramp, the upper tread surfaces 55 are arranged so that they are generally coplanar. The treads 54 are then secured to the stringers 52 by gluing their undersides at their end portions 63 to their respective scallops 58.

An end portion 64 of the stringer 52 is provided with half a scallop 65 which serves the same purpose as the half scallop 25 discussed previously.

Figure 5:
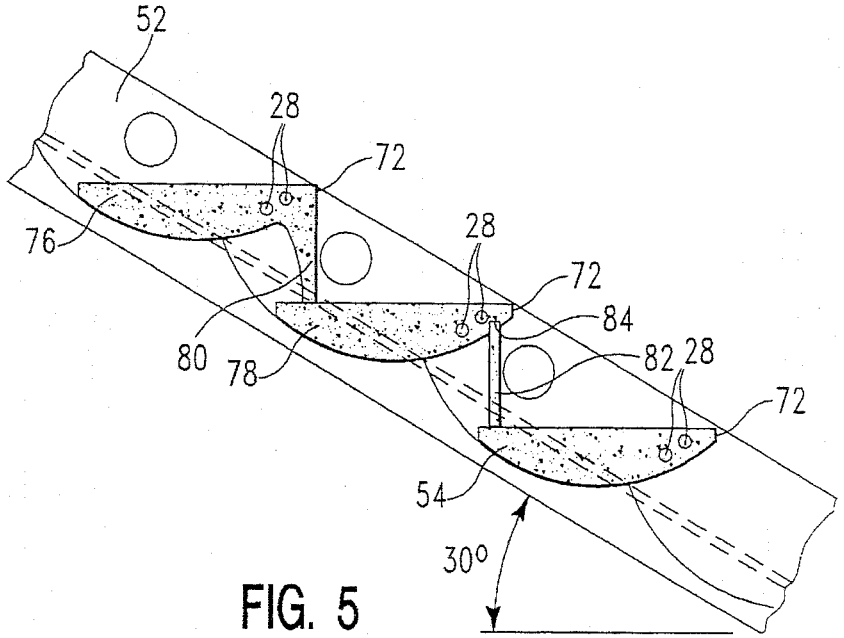
FIG. 5 is a partial side view of a staircase comprising the combination shown in FIG. 4, but with three different types of treads.

A staircase can be constructed by using the stringer and tread combination 50 shown in FIG. 4 together with a stringer 62 shown in FIG. 6. The staircase is established by raking the stringers 56, 62 to a required angle, for example 30 degrees as shown in FIG. 5, and arranging them opposite one another, suitably spaced apart and generally parallel to one another. The end portions 63 of the treads 54 are located in their respective scallops 58 and the upper tread surfaces 55 are leveled. The underside of each end portion 63 which is in contact with the scallops 58 is then secured to the respective stringers 52, 62 in the scallops 58 by means of gluing. FIG. 5 shows a partial view of a staircase 70.

The treads 54 are re-inforced in the same way as the treads 13 using metal bars 28 in the overlap 72. A metal bar re-inforcement 74 is further provided in the stringer 52, 62.

FIG. 5 shows that the staircase 70 comprises three different types of treads 54, 76, 78. Each of the treads 76, 78 has added to it a riser 80, 82 which depends from the front underside of the tread 76, 78. The tread 76 and riser 80 element has been integrally cast using concrete. The riser 82 is a separate concrete casting which fits into a groove 84 in the underside of the tread 78.

Figure 7:
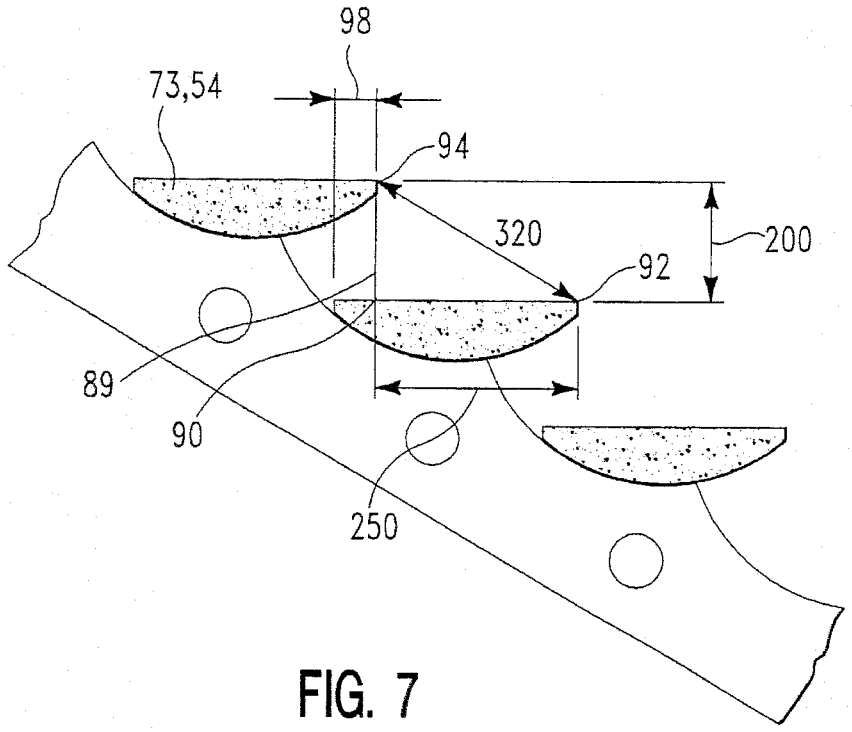
FIG. 7 is a side view of a stringer and tread combination used to show how a pitch of the scallops can be calculated.

To have comfortable stairs, the Neufert formula, in which twice the riser plus the tread width equals 600 to 650 mm, is applied. Using a riser of 200 mm and a tread width of 250 mm which is the steepest stair allowed by official building regulations in R.S.A. and applying the Neufert formula we get (2×200)r 250=650 mm which satisfies the criterion for comfortable stair design. FIG. 7 shows the riser 89 of 200 mm and the tread width of 250 mm, where the tread width is defined as the distance between the point 90 and the nose 92 of the tread 13.

Referring to FIG. 7 and applying Pythagoras' theorem a diagonal distance of 320 mm is generated from tread nose 92 of a first tread 13, 54 to the tread nose 94 of an adjacent tread 13, 54. The pitch of the scallops 16, 58 is taken as 320 mm.

The tread width 96 shown in FIGS. 1 and 4 is 310 mm when the stringer 12, 52 is horizontal and with the upper tread surfaces 14, 55 level or with the stringer 12, 52 inclined and with the upper tread surfaces 14, 55 generally located in the same plane. The gap 18, 60 is taken as 10 mm.

Using the dimensions above, the minimum required overlap 98 (FIG. 7) is obtained when the rake comes down to 27 degrees with the riser being 147 mm.

It will be appreciated that the riser 89, the tread width 96 and the overlap 98 will vary with a change in the rake.

Figure 8:
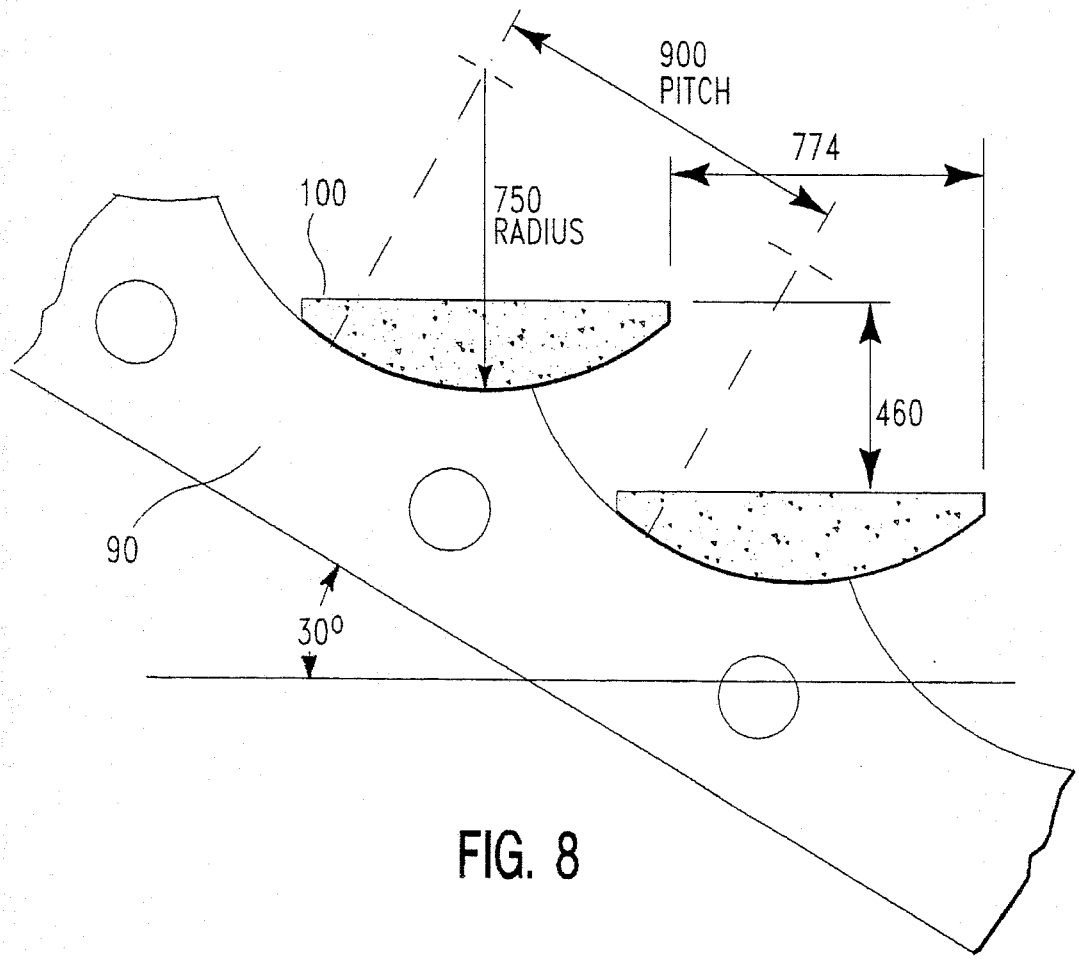
FIG. 8 is a side elevation showing grand stand seating.

The view in FIG. 8 of the drawings is a side elevation of a stringer 90 and seat 100 supported on it in a grandstand. The stringer is at 30° which is appropriate for grand stand seating and the stringer is provided with scallops on a 750 mm radius which is matched, of course, by the lower surfaces of the seats 100. The scallops are spaced on the stringers 90 with a 900 mm pitch along the length of the stringers 90. A clear width of each seat 100, that is, the sections of the seats 100 which are not overlapped by the next succeeding seat, is 774 mm in this arrangement. The height between seats is 460 mm. These features are indicated on the sketch. Holes in the stringer are of some interest for aesthetic and/or weight advantages.

With these considerations in mind the inventor has suggested a choice of a pitch (measured along the length of the stringer) in the region of 900 mm for the scallops and with this choice the following range is covered:

| SEAT HEIGHT | SEAT WIDTH | ANGLE |
|---|---|---|
| 300 | 849 | 19.4 |
| 310 | 844 | 20.1 |
| 320 | 811 | 20.8 |
| 330 | 837 | 21.5 |
| 340 | 833 | 22.1 |
| 350 | 829 | 22.8 |
| 360 | 825 | 23.5 |
| 370 | 820 | 24.3 |
| 380 | 816 | 24.9 |
| 390 | 811 | 25.6 |
| 400 | 806 | 26.3 |
| 410 | 801 | 27.1 |
| 420 | 796 | 27.8 |
| 430 | 791 | 28.5 |
| 440 | 785 | 29.2 |
| 450 | 779 | 30.0 |
| 460 | 774 | 30.7 |
| 470 | 767 | 31.4 |
| 480 | 761 | 32.2 |
| 490 | 754 | 32.9 |
| 500 | 748 | 33.7 |

The radius used for the scallops is determined by the following factors:

1. The structural depth required for the seat.
2. The length of interface between stringer and tread required to give an adequate bond of seat to the stringer.
3. The need for seats to overlap slightly when viewed in plan. The larger the radius, the thinner the structural depth of the seat segment and the smaller the bond interface at steeper angles.

A radius of 750 mm would probably optimise these criteria.

As reflected in the above table, typical angles for grand stand seats are somewhat lower than is typical for staircases, for example in the range of 20° to 30° measured to the horizontal.

Figure 9:
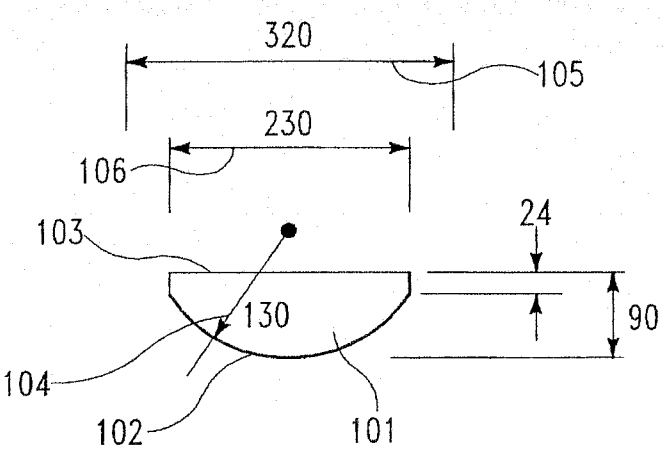
FIG. 9 is a side view of a tread.

As shown in FIG. 9, the typical tread 101 has an under (lower) surface 102 which is hemi-cylindrical, the upper surface 103 being flat for stepping on. The under surface 102 has a radius of curvature 104 which, by way of example, is 130 mm. This can be contrasted with the fact that the pitch 105 between treads is in this example 320 mm. The width 106 of the tread in this example is 230 mm.

Figure 10:
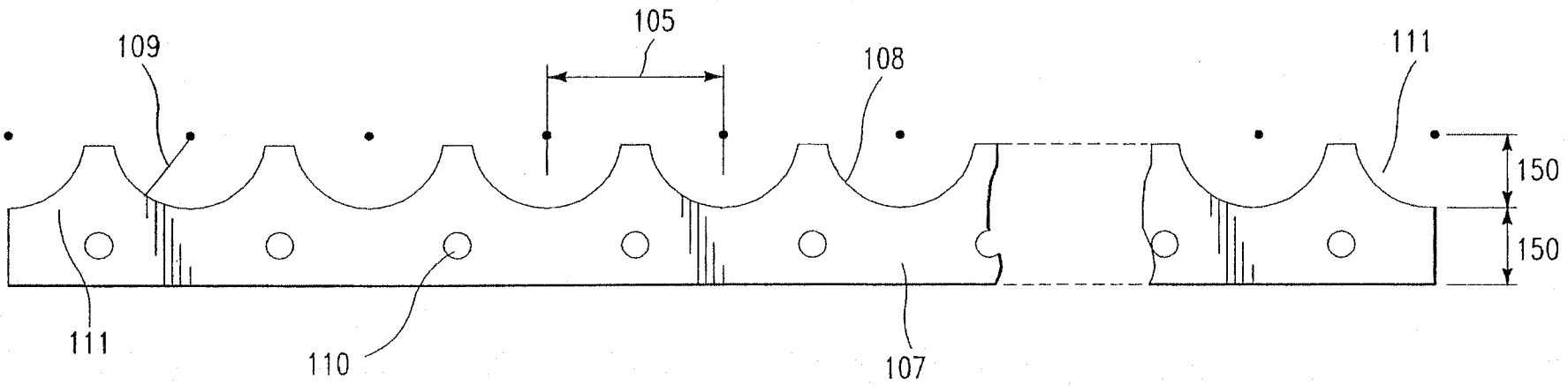
FIG. 10 is a side view of a stringer.

Thus the stringer 107 shown in FIG. 10 for use with these treads 101 has scallops 108 which have a radius of curvature 109 exactly equal to the radius of curvature 104 of the under surface of the treads 101, namely, in this example, 130 mm. Thus, the diameter of the scallops (and of course of the under surface of the treads) is 260 mm is smaller than the pitch 105 of 320 mm between the treads 101 in the assembled stairs or ladder. As can be seen in FIG. 10, the pitch 105 is the length of the pattern of two consecutive scallops 108, which is successively repeated along the length of the stringer 107.

Holes 110 are shown in the stringer as a lightening or attachment convenience. At the ends of the stringer a half scallop 111 is provided which permits the stringers to be joined end to end for providing walkways.

Figure 11:
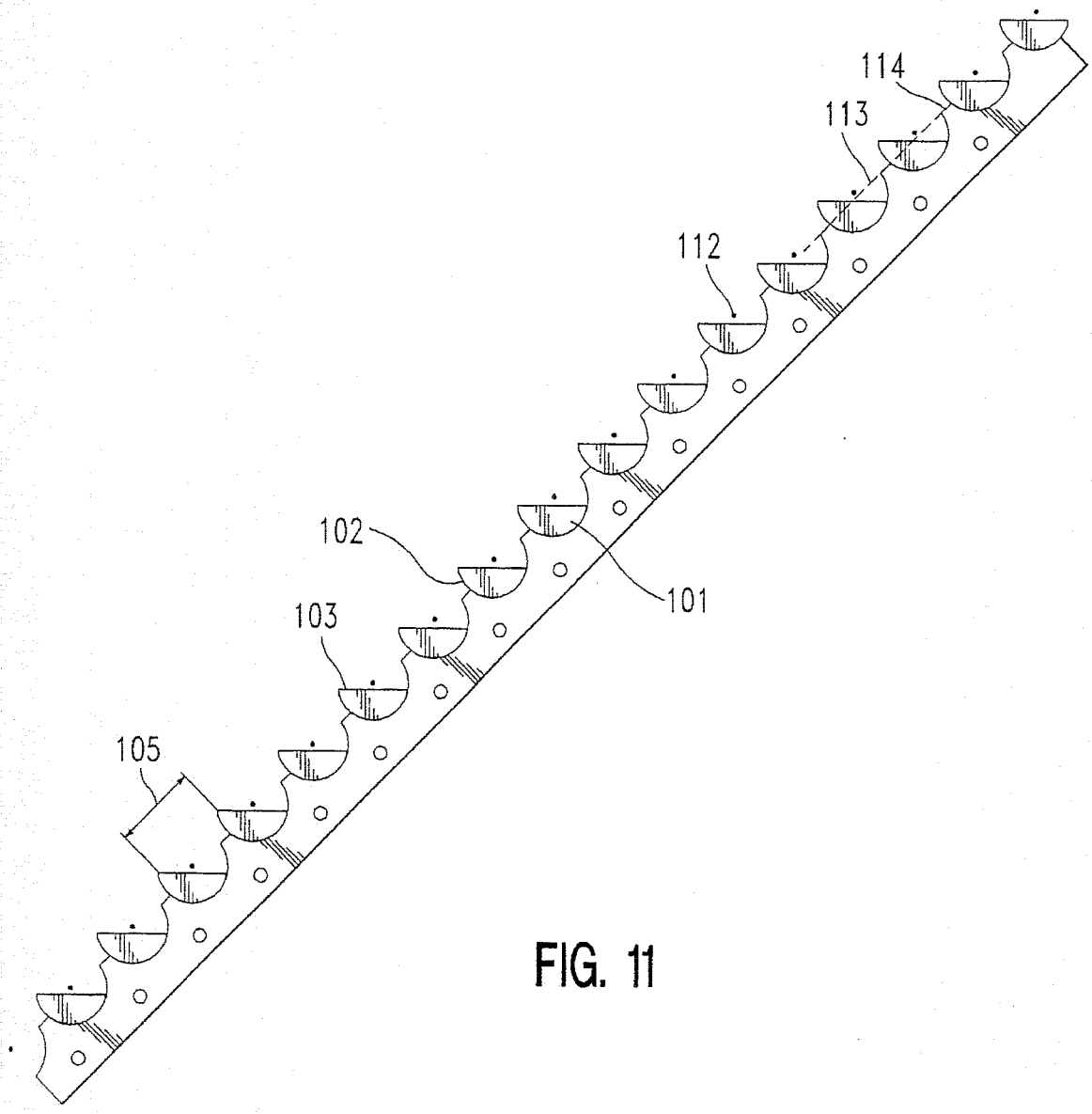
FIG. 11 is a side view of treads and stringers of the kind shown to provide a steep staircase at 45°.
Figure 12:
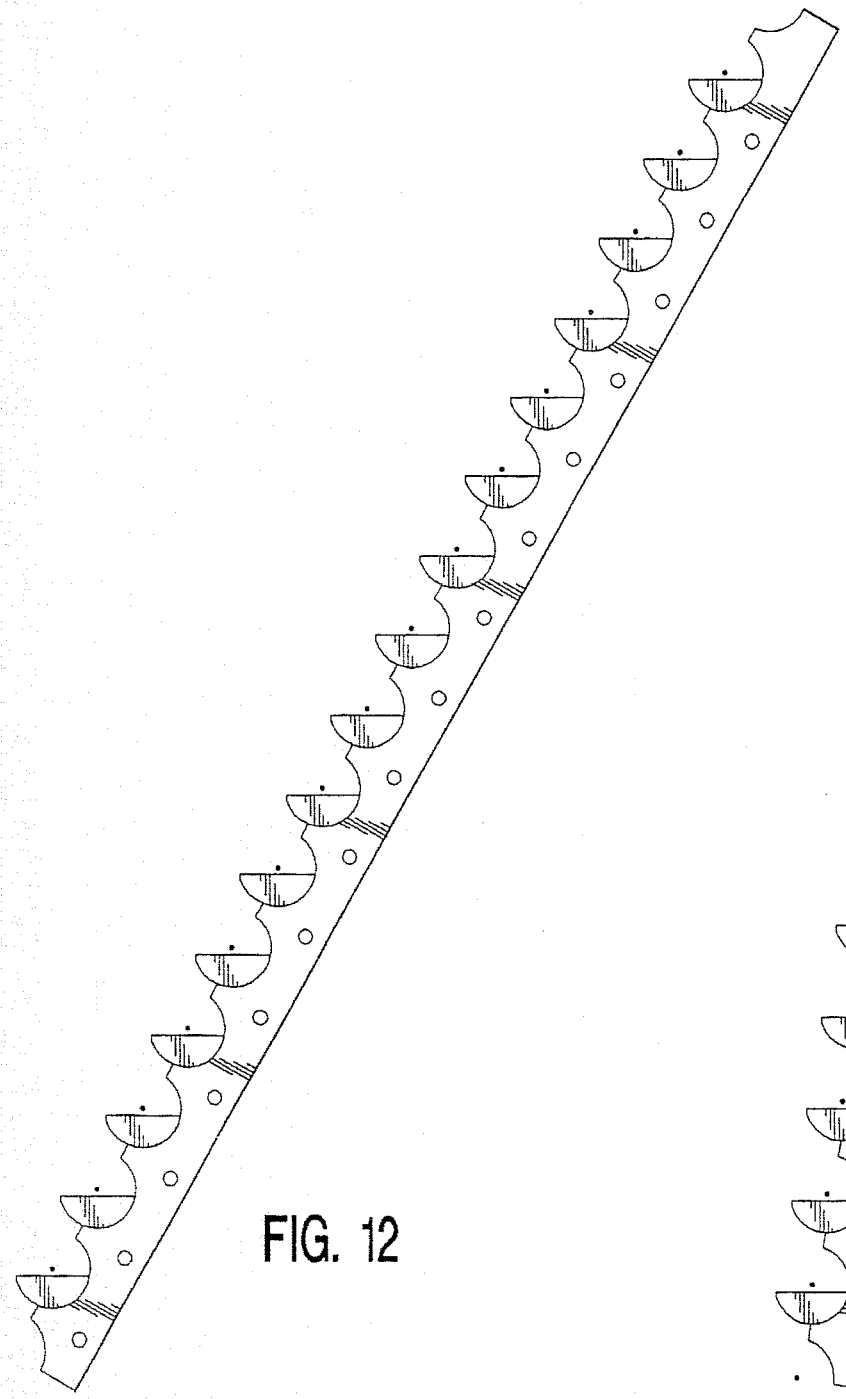
FIG. 12 shows treads and stringers combined to provide a ladder at 60°.

A staircase and a ladder made with these treads and stringers are shown in FIGS. 11 and 12, respectively, where the same numerals are used for the various features discussed with reference to FIGS. 9 and 10. In FIG. 11 the angle is 45° and in FIGS. 12 and 13, the angles are 60° and 80° respectively. Thus, the embodiment shown in FIG. 11 can be described as a very steep staircase and the embodiments shown in FIGS. 12 and 13 can be described as ladders.

Another important feature of the invention, which is preferably adopted, is that the center 112 on which the circular shape of each scallop is generated is co-linear with the upper edge 114 of the stringer so that a full semi-circular (i.e., 180°) scallop is available for placing the tread 101 in position. This means that the cantilever portion 102 of the tread 101 is quite reduced and, as will be seen with reference to the following FIGS. 12 and 13, still within acceptable limits even on the steepest use of the tread 101 and stringer combination of this invention. The short straight portions 114 between scallops could be reduced by increasing the diameter of the scallops, but not to a diameter greater than the pitch 105 between scallops. This would have the advantage that if the stringer is placed horizontally to make a walkway, then the edges or the treads will be contiguous to provide a walkway without gaps.

Figure 13:
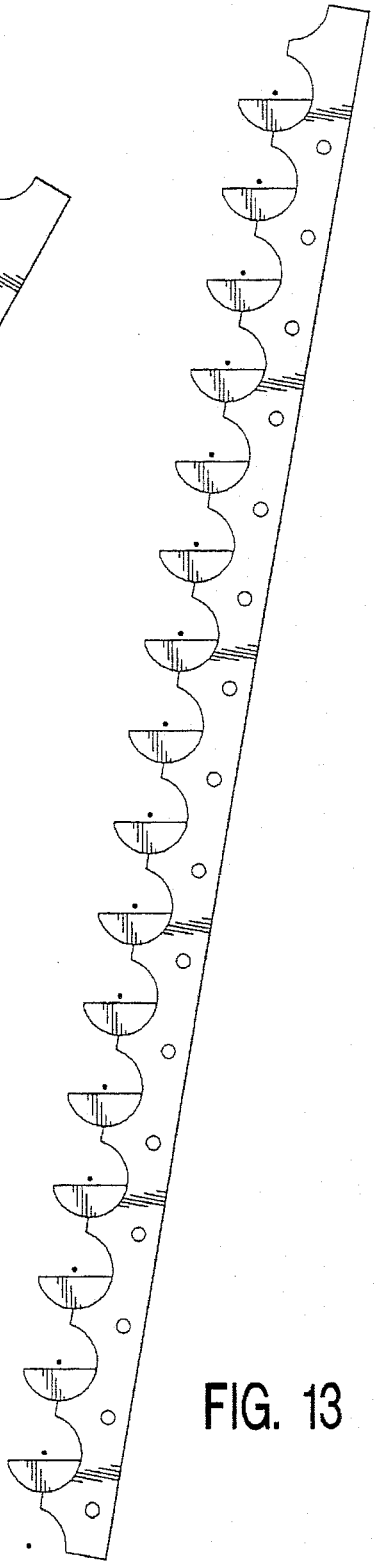
FIG. 13 shows tread and stringers combined to provide a ladder at 80°.

As shown in FIGS. 12 and 13 this tread and stringer combination is amenable to very steep inclinations, as shown for example in FIGS. 12 and 13 of 60° and 80°, respectively.

Figure 14:
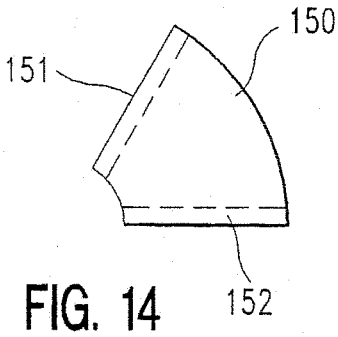
FIG. 14 is a plan view showing a walkway landing.

FIG. 14 shows a landing 150 to accommodate a change of direction of a walkway, having half scallops 151 and 152 to mate with co-acting half scallops at the abutting ends of stringers (e.g., as shown in FIG. 1, the half scallop 25) to carry a tread.

Figure 15:
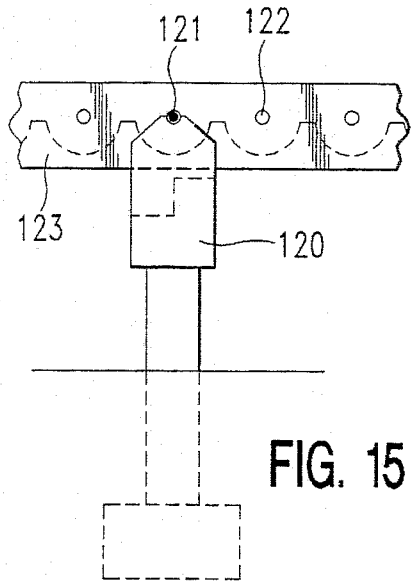
FIG. 15 is a side elevation showing a capital and support column.
Figure 16:
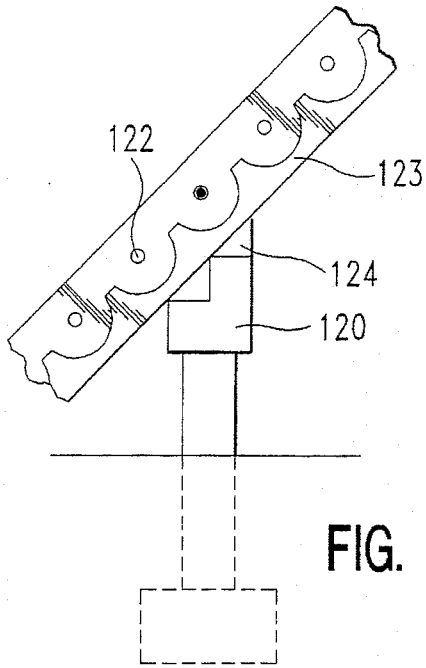
FIG. 16 is a side elevation from the other side of the capital and support column.
Figure 17:
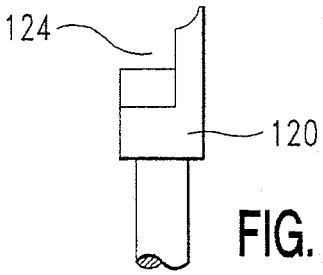
FIG. 17 is a front elevation of the capital and support column.

FIGS. 15 to 17 show the use of a capital and column type support for walkways and staircases. The capital comprises cylindrical body 120 with a groove for carrying a pin 121 which passes through a hole 122 of the stringer 123. A face 124 of the capital is cut away to permit the stringer 123 to be mounted at an inclination (in this example of up to 38°). After installation, grout is applied in the spaces visible in the view of FIG. 16.

Figure 18:
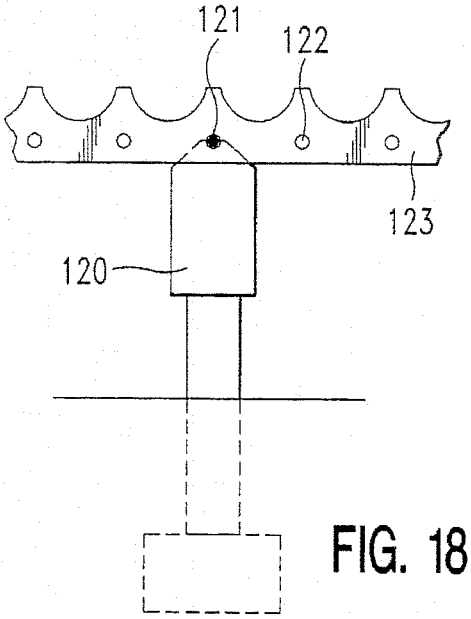
FIG. 18 is a side view of the capital and support column supporting an alternative stringer.
Figure 19:
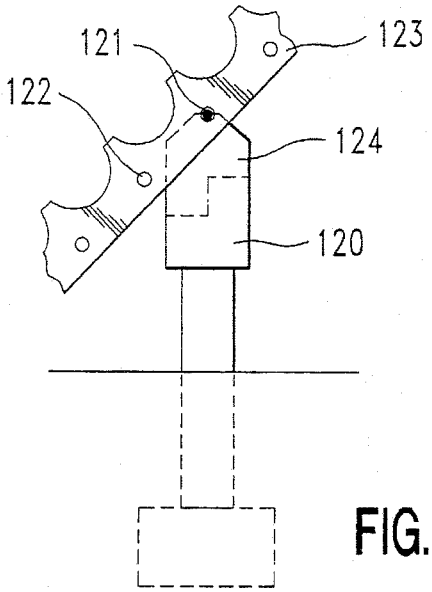
FIG. 19 is a side view from the other side of the capital and support column and stringer.

The use of the same capital for the type of stringer in which the scallops are placed in the upper surface of the stringer is shown in FIGS. 18 and 19, the same reference numerals have being used. With the arrangement shown, left hand and right hand capitals are provided for alternate sides of the stringers.

Figure 20:
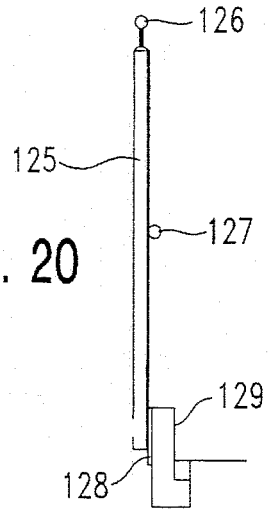
FIG. 20 is a front elevation of a stanchion with hand rail and knee rail attached to a stringer.
Figure 21:
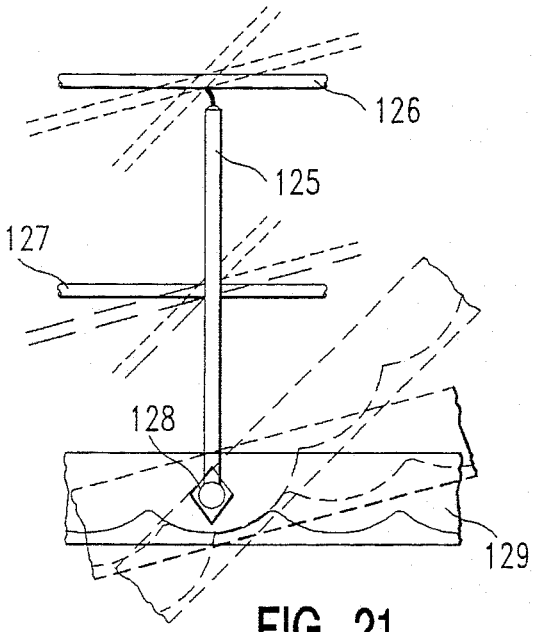
FIG. 21 is a side elevation of the stanchion of FIG. 20 showing alternative angles of inclination of the stringer.
Figure 24:
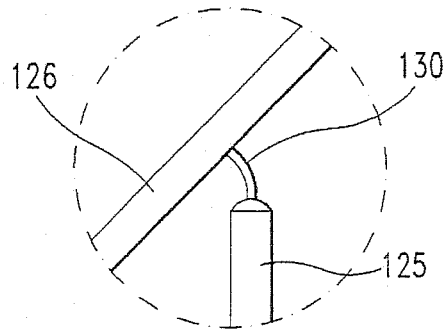
FIG. 24 is an enlarged detail showing a connection between a hand rail and stanchion.

FIGS. 20 and 21 show the mounting of a stanchion 125 by means of a flange 128 on to the side of a stringer 129. Hand rail 126 and knee rail 127 are carried by the stanchion 125. The detail in FIG. 24 shows how the hand rail 126 is fixed to the top of the stanchion 125 by means of a steel rod of mild steel 130 which can be bent on site to the required angle thus co-operating in this way with the flexibility of the system in being able to adopt any suitable angle of rake.

Figure 22:
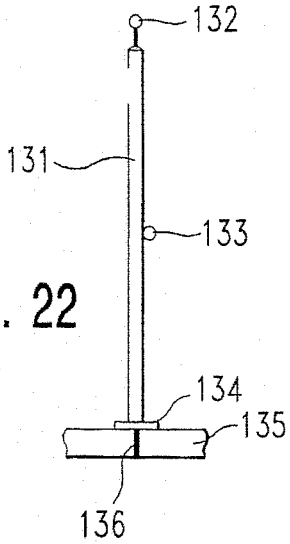
FIG. 22 is a front elevation showing a stanchion with hand rail and knee rail attached to a tread.
Figure 23:
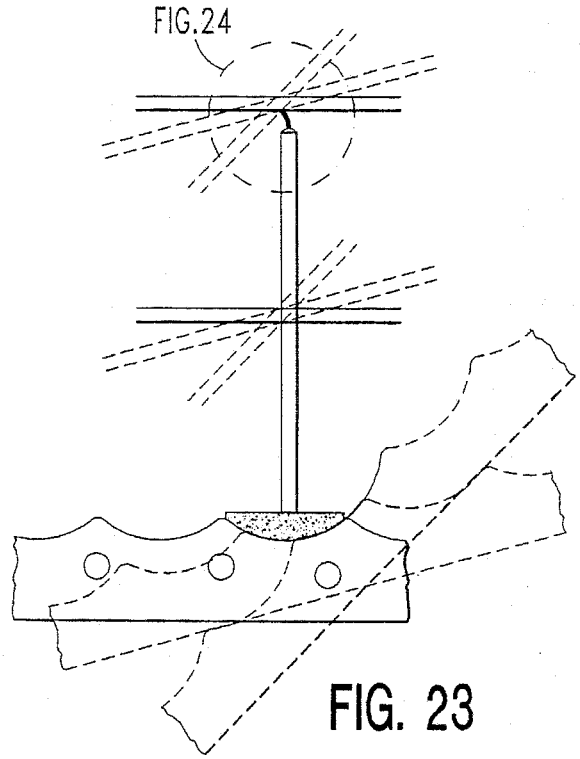
FIG. 23 is a side elevation showing the stanchion of FIG. 22 attached to a tread, with the stringers being arranged at various angles.

FIGS. 22 and 23 show a stanchion 131 carrying a hand rail 132 and knee rail 133. However, in this case the stanchion 131 is mounted, at its base 134, to a tread 135 which is provided with a suitable hole 136 for this purpose. A bolt projects from the lower end of the stanchion 131, at its base 134, passes through the hole 136, and is bolted in position.

Figure 25:
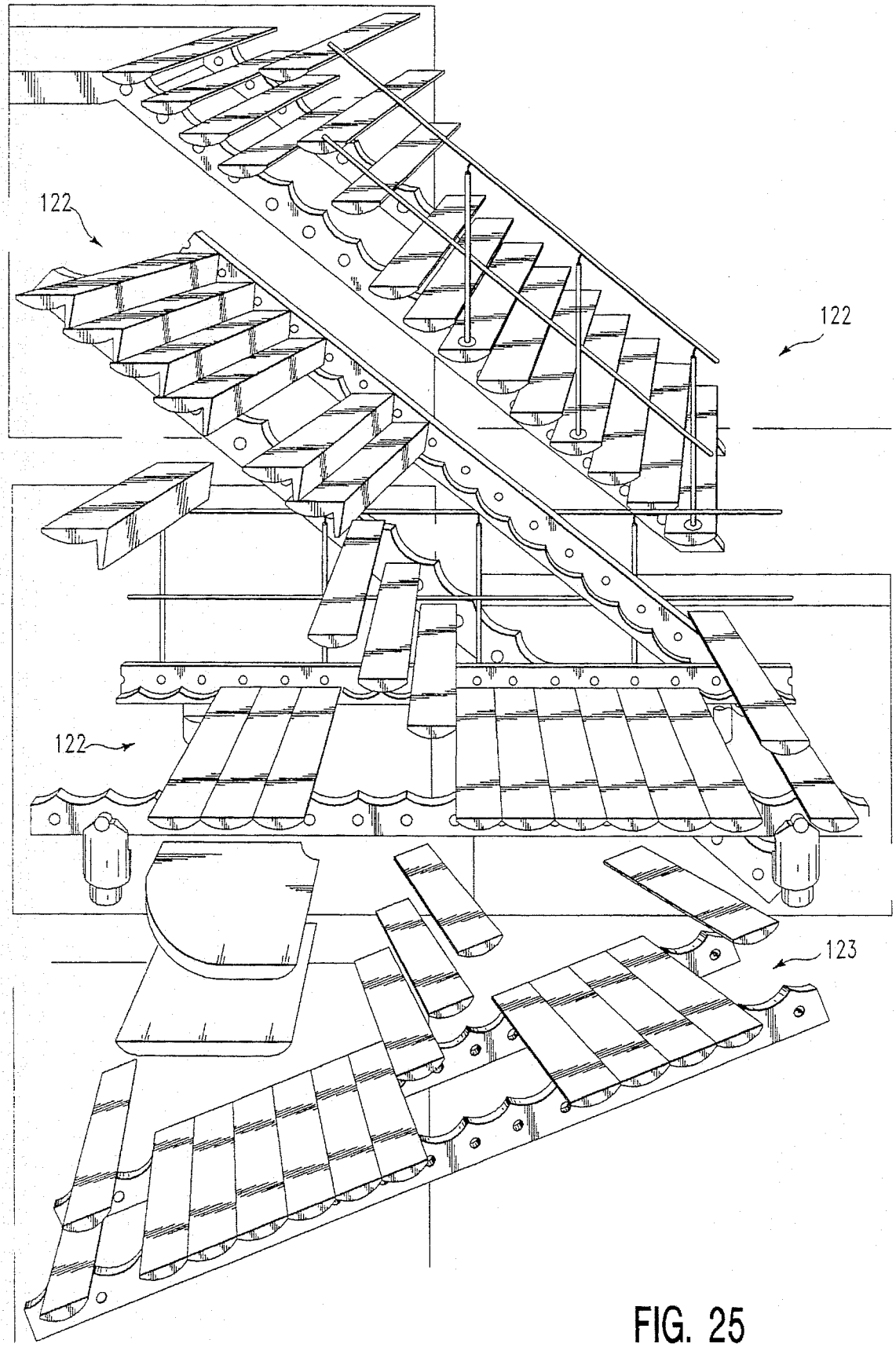
FIG. 25 shows an exploded view of various applications of the invention.

FIG. 25 shows at 120 a staircase structured using two stringers and a plurality of treads and also showing hand rails fixed to the treads.

The feature at 121 shows two stringers in this case with the scallops formed on inwardly facing corbels on each stringer and with the treads showing an integrally formed riser depending from each tread so as to close the space between treads.

The feature at 122 shows a horizontal walkway using the same stringers and treads as shown in the previous drawings, illustrating the versatility of the apparatus.

The feature at 123 shows again the same stringers and treads forming an inclined ramp.

The Neufert formula permits the pitch distance between the noses of the treads, and accordingly the pitch distance of the scallops in the stringers, to be made. Thus, in accordance with the invention, a preferred pitched distance is 320 mm or lies between, for example 290 and 330 mm. Standardizing on this dimension of pitch for the scallops in the stringers allows a system for staircases, walkways and ramps to be offered to the public which can be employed in all the different ways described in this invention. In the installation of a staircase, a fixed dimension is the pitch of 320 mm. This allows the variation of the rise dimension, the tread dimension or the angle of the staircase in any particular application.

Most frequently, because the floor to floor height for a particular staircase is pre-determined by the building, a riser height must be chosen as the starting point. The following example illustrates how the method is then applied:

Example: Given a floor to floor height of 2 635 mm

1. Choose the number of risers (say 14) 2 635/14=188.214 mm riser
2. The tread length by Pythagoras (using 320 for the hypotenuse) will be $$T=\sqrt{320^2-188.214^2}=258.796$$

3. The angle by cosine will be 258.796/320=0.809=36°
4. The going distance in true plan will be: 13 treads@258.796 mm/tread=3 364 mm The same stringers and treads of the invention can be illustrated in the following tabulation of the various options available to the designer.

| RISER | TREAD | ANGLE | 2 R + T | STEP CLIMBING EFFECT | SPECIAL CAUTION |
|---|---|---|---|---|---|
| 110 | 30 | 20°05 | 520 | Easy going mincing step | 20°∠ |
| 120 | 297 | 22°00 | 537 | Easy going mincing steps | Angles below 20° |
| 130 | 292 | 24°35 | 552 | Easy going mincing steps | may be better served |
| 140 | 288 | 25°57 | 568 | Easy going mincing steps | by Winstep ramps. |
| 150 | 283 | 27°56 | 583 | Easy going mincing steps | 28°∠ WINTEC does not recommend the use |
| 160 | 277 | 30°00 | 597 | Comfort zone | 30°∠ of rake angles greater |
| 170 | 271 | 32°58 | 611 | Comfort zone | than 40°. |
| 180 | 265 | 34°14 | 625 | Comfort zone | |
| 190 | 258 | 36°25 | 638 | Comfort zone | Rake angles greater than 38°41' do not |
| 200 | 250 | 38°41 | 650 | Comfort zone | 38°∠ comply with National |
| | | See special caution for angles over 40° | | | Building Regulations |
| 210 | 241 | 41°04 | 661 | Steep big strides | 41°∠ SABS 0400 and fall |
| 220 | 232 | 43°26 | 672 | Steep big strides | outside stair design |
| 226 | 226 | 45°00 | 679 | Steep big strides | 45°∠ comfort zones. |

As can be seen from the foregoing tabulation, the angles of staircases using the apparatus for this invention are infinitely variable between 0° and 40°, or even 45°.

A system of stringers and treads with other dimensions can be provided for very steep staircases or ladders above 45°, as described.

I claim:

1. A device adaptable for forming a staircase, walkway and ramp, the device comprising: a stringer which is lengthwise provided with successive, integrally formed, scallops, each of which scallops has a lengthwise shape conforming to an arc of a circle, each scallop begins at the end of a previous scallop on the same longitudinal line of the stringer; and treads, each tread having an integral underside, the integral underside has a co-acting shape to that of the scallops such that the scallops can accommodate at least part of the underside of the tread, wherein each tread has a width which is equal to, or slightly less than, a pitch of the scallops.

2. A device as claimed in claim 1, wherein each stringer has two end portions, both end portions of each stringer are provided with half of the scallop whereby two stringers having such end portions can be mated in an end to end configuration which will provide the full scallop adapted to accommodate the tread.

3. A device as claimed in claim 2 further comprising a landing adapted to join with the end of each of two stringers and treads, the landing having mating half scallops on two of its edges which mate with the half scallops of the adjoining stringer ends to provide the full scallop adapted to accommodate the tread.

4. A ladder comprising: a stringer provided with integrally formed successive scallops each of which has a lengthwise shape conforming to an arc of a circle, each scallop begins at the end of the previous scallop on the same longitudinal line of the stringer; and treads, each tread having an underside, the underside having a co-acting shape to that of the scallops such that the scallops can accommodate at least part of the underside of the tread, wherein a diameter of each scallop is less than a pitch between treads and the arc of each scallop is close to a semi-circle, wherein the circular shape of each scallop is generated on a center which is collinear with an upper edge of the stringer.

* * * * *